US006612170B2

(12) United States Patent
Brown

(10) Patent No.: US 6,612,170 B2
(45) Date of Patent: Sep. 2, 2003

(54) PORTABLE LIGHTWEIGHT HOME AND TRAVEL GYM

(76) Inventor: Thomas D. Brown, Rte. 2 Box A236, Dublin, TX (US) 76446

( * ) Notice: Subject to any disclaimer, the term of this patent is extended or adjusted under 35 U.S.C. 154(b) by 0 days.

(21) Appl. No.: 09/816,105

(22) Filed: Mar. 26, 2001

(65) Prior Publication Data

US 2002/0055424 A1 May 9, 2002

Related U.S. Application Data

(60) Provisional application No. 60/192,550, filed on Mar. 28, 2000.

(51) Int. Cl.[7] ..... A61B 5/22

(52) U.S. Cl. ..... 73/379.06

(58) Field of Search ..... 73/379.01, 379.08, 73/379.06, 379.09, 379–381; 482/10, 6, 123, 91, 92, 51, 52, 1, 70, 57, 111, 120, 38, 131, 96, 134, 135, 94; 280/252

(56) References Cited

U.S. PATENT DOCUMENTS

| | | | | | |
|---|---|---|---|---|---|
| 1,019,861 | A | * | 3/1912 | Titus | 482/123 |
| 4,257,592 | A | * | 3/1981 | Jones | 482/131 |
| 4,371,162 | A | * | 2/1983 | Hartzell | 272/134 |
| 4,607,841 | A | | 8/1986 | Gala | |
| 4,647,038 | A | | 3/1987 | Noffsinger | |
| 4,647,039 | A | | 3/1987 | Noffsinger | |
| 4,890,495 | A | | 1/1990 | Slane | |
| 4,912,638 | A | | 3/1990 | Pratt | |
| 4,972,711 | A | | 11/1990 | Jain et al. | |
| 5,037,089 | A | | 8/1991 | Spagnuolo et al. | |
| 5,112,287 | A | | 5/1992 | Brewer | |
| 5,269,737 | A | | 12/1993 | Sobotka | |
| 5,275,045 | A | * | 1/1994 | Johnston et al. | 73/379.01 |
| 5,314,394 | A | | 5/1994 | Ronan | |
| 5,480,369 | A | | 1/1996 | Dudley | |
| 5,653,665 | A | | 8/1997 | Neeley | |
| 5,749,668 | A | * | 5/1998 | McIlvain et al. | 482/79 |
| 5,762,592 | A | * | 6/1998 | Neveux | 482/131 |
| 5,941,807 | A | * | 8/1999 | Cassidy et al. | 482/146 |
| 6,027,429 | A | * | 2/2000 | Daniels | 482/5 |
| 6,090,020 | A | * | 7/2000 | Webber | 482/100 |
| 6,106,444 | A | * | 8/2000 | Maingart | 482/95 |
| 6,162,153 | A | * | 12/2000 | Perez | 482/96 |

FOREIGN PATENT DOCUMENTS

| | | |
|---|---|---|
| EP | 0 445 617 A1 | 9/1991 |
| GB | 2 048 085 A | 12/1980 |
| GB | 2 124 916 A | 2/1984 |
| WO | WO 98/23335 | 6/1998 |

* cited by examiner

*Primary Examiner*—Max Noori
(74) *Attorney, Agent, or Firm*—Richard C. Litman

(57) ABSTRACT

An isometric exercise apparatus includes a platform and a strap/cable/pulley system. A load cell or strain gauge type sensor is positioned beneath the platform and is attached to and stressed by the strap/cable/pulley system when a user performs an isometric exercise function. An LED readout module is electrically connected to the cell and is programmed to display the stress on the cell as pounds or kilograms of lifted weight.

9 Claims, 8 Drawing Sheets

PORTABLE LIGHTWEIGHT HOME AND TRAVEL GYM

CROSS-REFERENCE TO RELATED APPLICATION

This application claims the benefit of U.S. Provisional Patent Application Serial No. 60/192,550, filed Mar. 28, 2000.

BACKGROUND OF THE INVENTION

1. Field of the Invention

The present invention generally relates to exercise apparatus. More specifically, the present invention is drawn to a light-weight, portable, isometric exercise apparatus which allows a user to develop muscular strength without the use of heavy, space-consuming barbells and/or weight machines.

2. Description of Related Art

In the mid to late 1940s, an exercise regimen was developed and marketed as "Dynamic Tension". This particular regimen, now called "isometrics", became popular because it involved almost no investment in equipment and could be practiced in the privacy of one's home. In recent years, however, isometric exercise has fallen out of favor with a majority of fitness enthusiasts. Many believe that the reason for the disfavor is the need to quantify the exercise experience. In short, the exerciser wants some way, besides time, to tangibly measure the amount of weight lifted during the exercise session.

In the prior art, U.S. Pat. Nos. 4,607,841 (Gala), 4,647,038 (Noffsinger), 4,647,039 (Noffsinger), 4,890,495 (Slane), 4,912,638 (Pratt, Jr.), 4,972,711 (Jain et al.), 5,037,089 (Spagnuolo et al.), 5,314,394 (Ronan), British Patent 2,124,916 A and European Patent 0,445,617 A1 all disclose exercise equipment having means to measure the quantity of weight lifted or moved. However, all the above patents involve space devouring machines which are somewhat complicated to use and are not easily portable.

U.S. Pat. Nos. 1,019,861 (Titus), 4,371,162 (Hartzell), 5,112,287 (Brewer), 5,269,737 (Sobotka), 5,480,369 (Dudley), 5,653,665 (Neeley) and British Patent 2,048,085 A show exercise equipment of the resistance type. The instant patents have no means to measure and translate the quantity of resistance to a weight readout.

WIPO Patent WO 98/23335 discloses a portable isometric exerciser having a load-measuring device. The exerciser, however can only be utilized when the user is in a standing position. Furthermore, only the back and leg muscles receive benefit from the isometric exercise.

None of the above inventions and patents, taken either singly or in combination, is seen to disclose a light-weight, portable, isometric exercise apparatus having an LED readout indicator for converting the applied force to weight as will subsequently be described and claimed in the instant invention.

SUMMARY OF THE INVENTION

The instant invention is a light-weight, portable, exercise apparatus adapted for home and travel. The apparatus employs isometrics in a manner that develops more resistance than Olympic bar bells. The present invention has registered more than one-thousand pounds of measured force. Thus, a user can develop muscular strength in the same way as if exercising with bar bells, without having the attendant problems (non-portability, cumbersomeness, heaviness, etc.) that bar bells present.

The exercise apparatus of the instant invention consists essentially of five major components which are (1) a metal platform; (2) a strap/cable/pulley system; (3) a sensor; (4) an LED readout module; and (5) an exercise member or bar. The components are quasi-separable and are sized to make the invention conveniently portable so that the user may easily continue workouts while away from home.

Versatility of design allows a user of the exercise apparatus to practice at least four basic lift positions, namely the bench press, the squat lift, the military press, and the biceps curl. The apparatus also allows the user to vary positions for each basic lift.

The LED readout module is innovative in that it may be programmed to measure the attained weight "lifted" to the exact pound (or kilogram). Since the weight "lifted" fluctuates during the lift and eventually retreats to zero, the readout can be programmed to save the highest attained weight so that the user may check after each lift.

Accordingly, it is a principal object of the invention to provide an exercise apparatus which utilizes the isometric principle.

It is another object of the invention to provide an isometric exercise apparatus which is light-weight, versatile and portable.

It is a further object of the invention to provide an isometric exercise apparatus that develops more resistance than Olympic bar bells.

Still another object of the invention is to provide an isometric exercise apparatus that measures and displays the weight "lifted" during a workout.

It is an object of the invention to provide improved elements and arrangements thereof in an apparatus for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
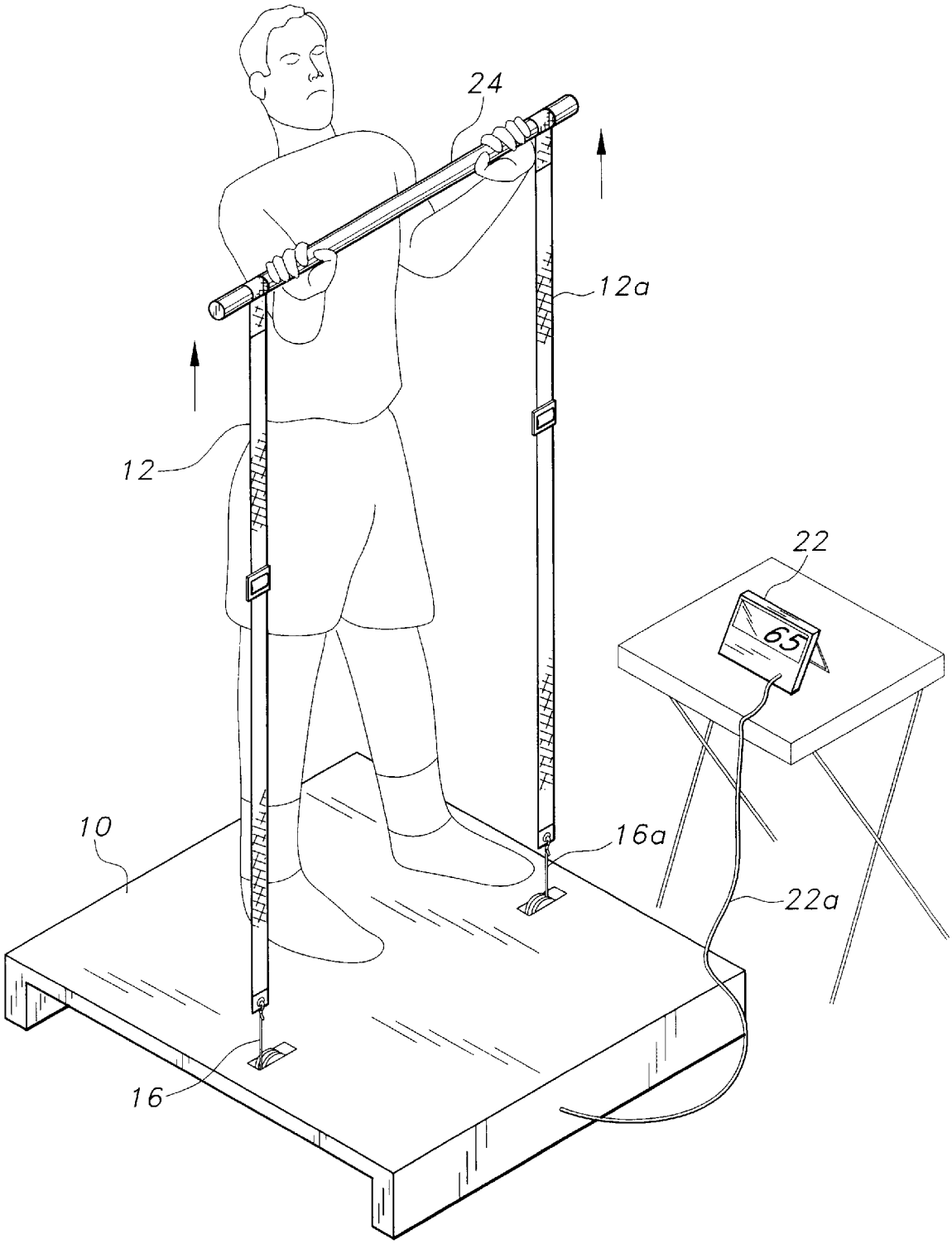
FIG. 1 is an environmental, perspective view of a portable, light-weight gym according to the present invention.
Figure 2:
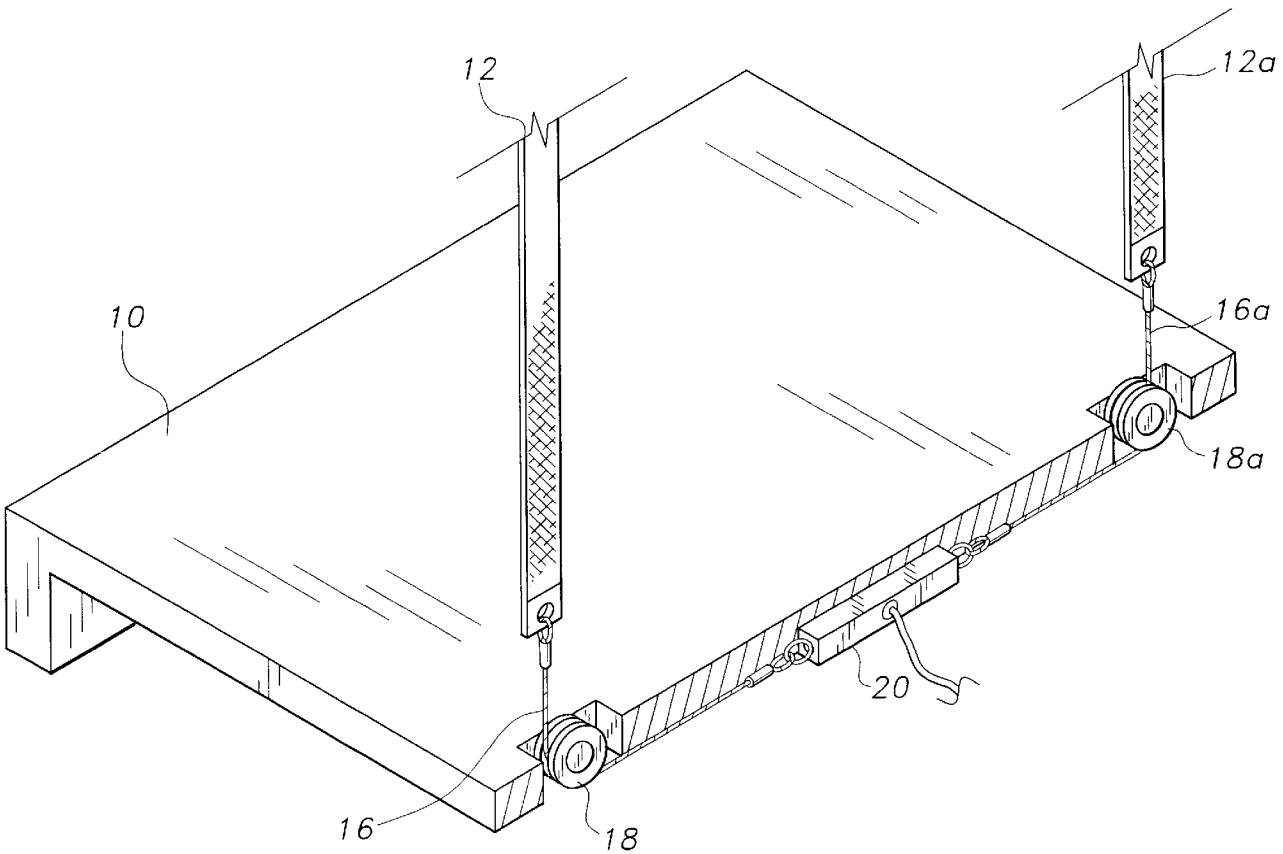
FIG. 2 is a partial, cut-away view of a portable, light-weight gym according to the present invention.

As illustrated in FIGS. 1–2, a first embodiment of the present invention comprises a platform 10. The platform is U-shaped with the legs of the U adapted to rest on a level surface (floor). Platform 10 is constructed of a light-weight material such as extruded aluminum. Although illustrated as a square, the dimensions of the platform may vary as needed. It has been determined that optimal dimensions for the platform should be approximately twenty-four inches long and seven inches wide with an underneath clearance of one inch. Such dimensions have proven adequate to allow a user to sit, stand, or lie on the platform.

Adjustable straps 12 and 12*a* are positioned at either end of platform 10. Straps 12 and 12*a* should be spaced at least twenty-two inches apart. The straps may be fabricated from any well-known strong, and wear-resistant web material (or chains), and are designed so that their lengths may be adjusted. At their lower ends, the straps are attached to respective first ends of conventional wire cables 16 and 16*a*. Slots, formed through platform 10, are designed to accommodate pulleys 18 and 18*a* therein. Cables 16, 16*a* extend from the ends of the straps underneath platform 10 via the pulleys 18, 18*a*. Each cable has a second end attached to a direct-pull type load cell 20 in any suitable and convenient manner. It is envisioned that the straps may be directly fastened to the cell, thereby obviating the need for pulleys and cables.

Cell 20 is disposed to "float" underneath platform 10 and is a conventional strain gauge or load cell having a rated capacity of at least one thousand pounds. Although only a single cell is shown, it is contemplated that plural cells, each having a smaller capacity, may be utilized if desired, and such cells may be attached to the platform in any suitable manner. An LED readout module 22 is electrically connected to cell 20 via line 22*a*. LED module 22 records the load applied to cell 20 as will be explained below.

The upper ends of straps 12, 12*a* are attached to an exercise bar 24. Bar 24 is of conventional tubular design and may be fabricated from any material strong enough to withstand the lifting forces that are applied. Bar 24 may be detached from the upper ends of the straps to enhance portability.

To use the apparatus of the instant invention, a user would adjust the length of the straps 12, 12*a* to accommodate user height and the type of exercise position desired. Pulling or pushing bar 24 upward will cause force to be translated via the straps and cables. Such force will be effective to pull the cell 20 in opposite directions in a horizontal plane. As is well known in the art, the strain on the cell produces an electric signal, which signal is transmitted to LED module 22 via line 22*a*. LED module 22 is programmed to produce a readout that will translate the strain on the sensor into equivalent pounds or kilograms of lift.

Figure 3:
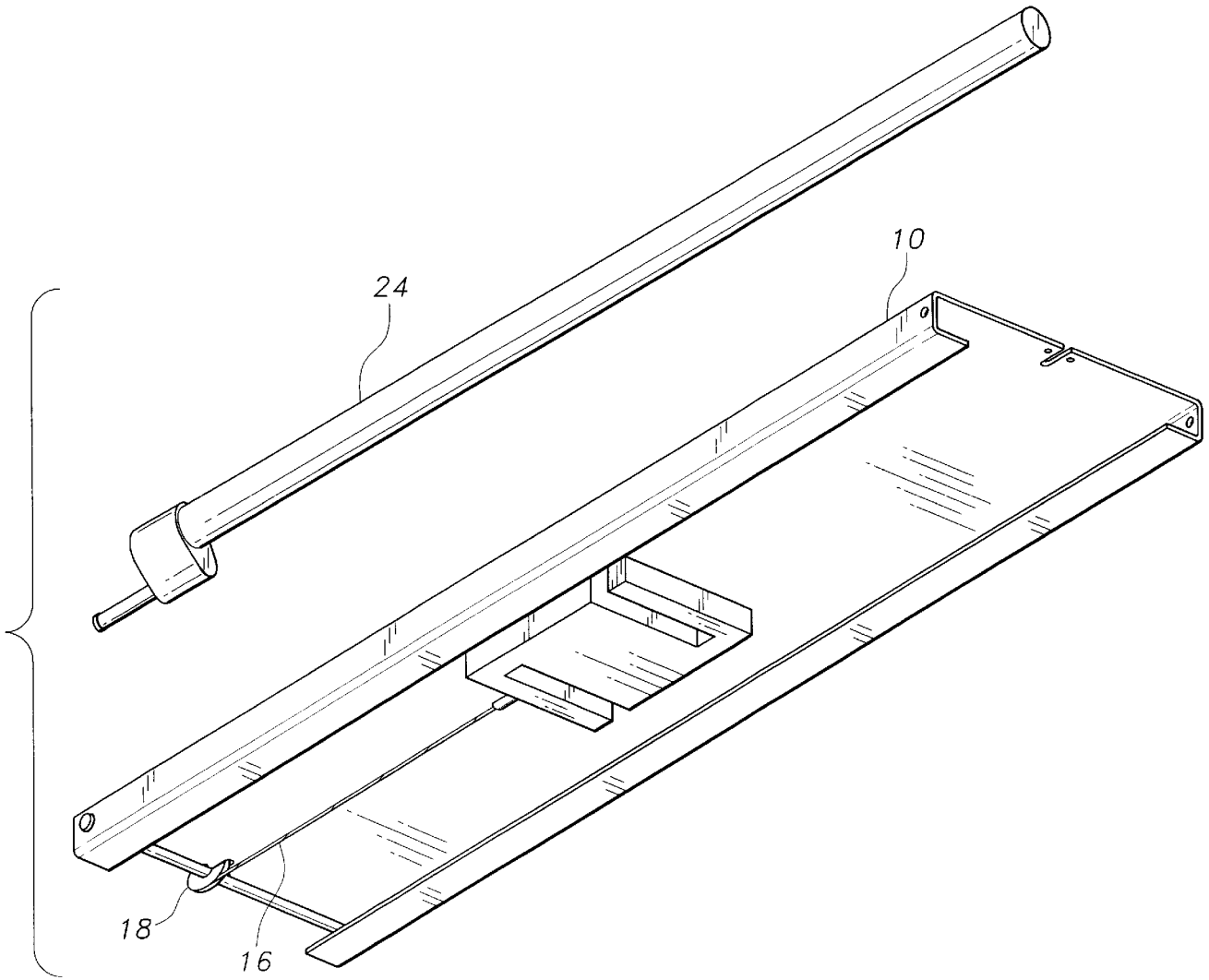
FIG. 3 is a partial, exploded, perspective view of a second embodiment of a portable gym according to the present invention.

FIG. 3 is illustrative of a second embodiment wherein cell 20*a* is configured in the shape of an S. Exercise bar 24 is provided with conventional, spring-loaded connectors 26 at each end (only one shown) to enhance connecting and disconnecting the straps.

Figure 4:
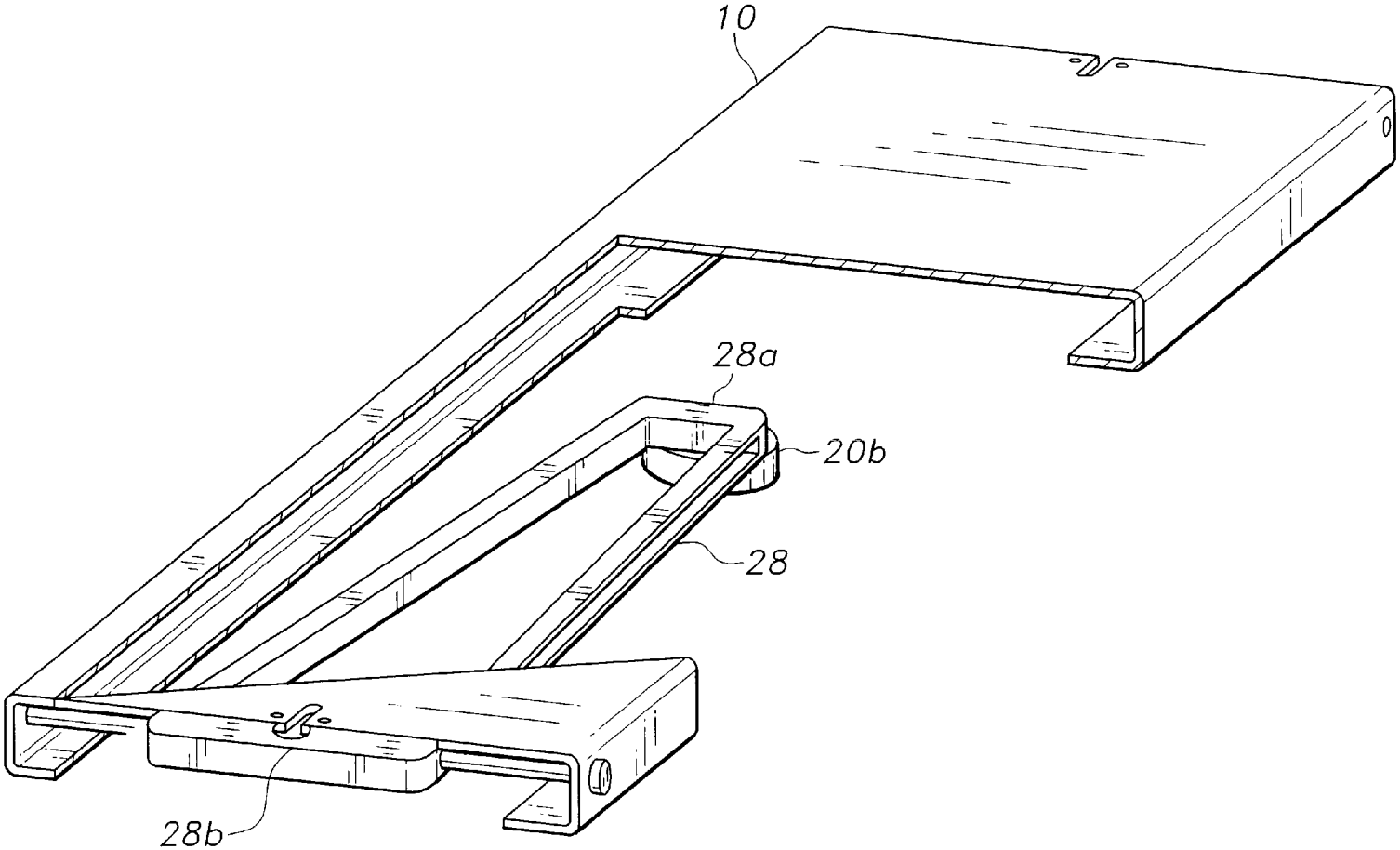
FIG. 4 is a partial, cut-away, perspective view of a third embodiment of a portable gym according to the present invention.

An alternative to a direct pull cell is shown in FIG. 4. Pressure-responsive load cells 20*b* (only one shown) are disposed to rest on a planar surface. A lever 28 is positioned so that one end 28*a* rests atop cell 20*b*. The other end 28*b* is attached to a wire cable (not shown) such that an upward pull on the cable will cause end 28*a* to move in a downward direction and apply pressure on the top of cell 20*b*. As well known in the art, this applied pressure may be translated into an electrical signal to produce a readout as discussed above.

Figure 5:
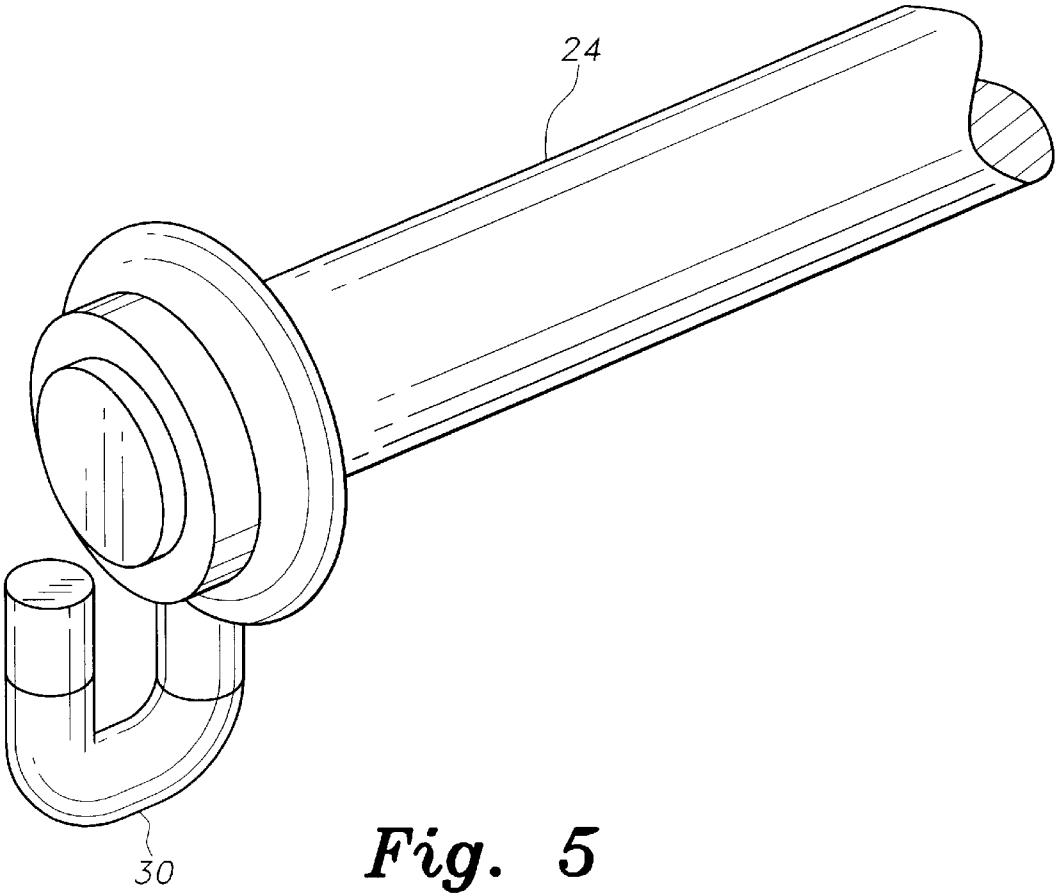
FIG. 5 is a perspective view of a variation in the strap connection in a portable gym according to the present invention.
Figure 6:
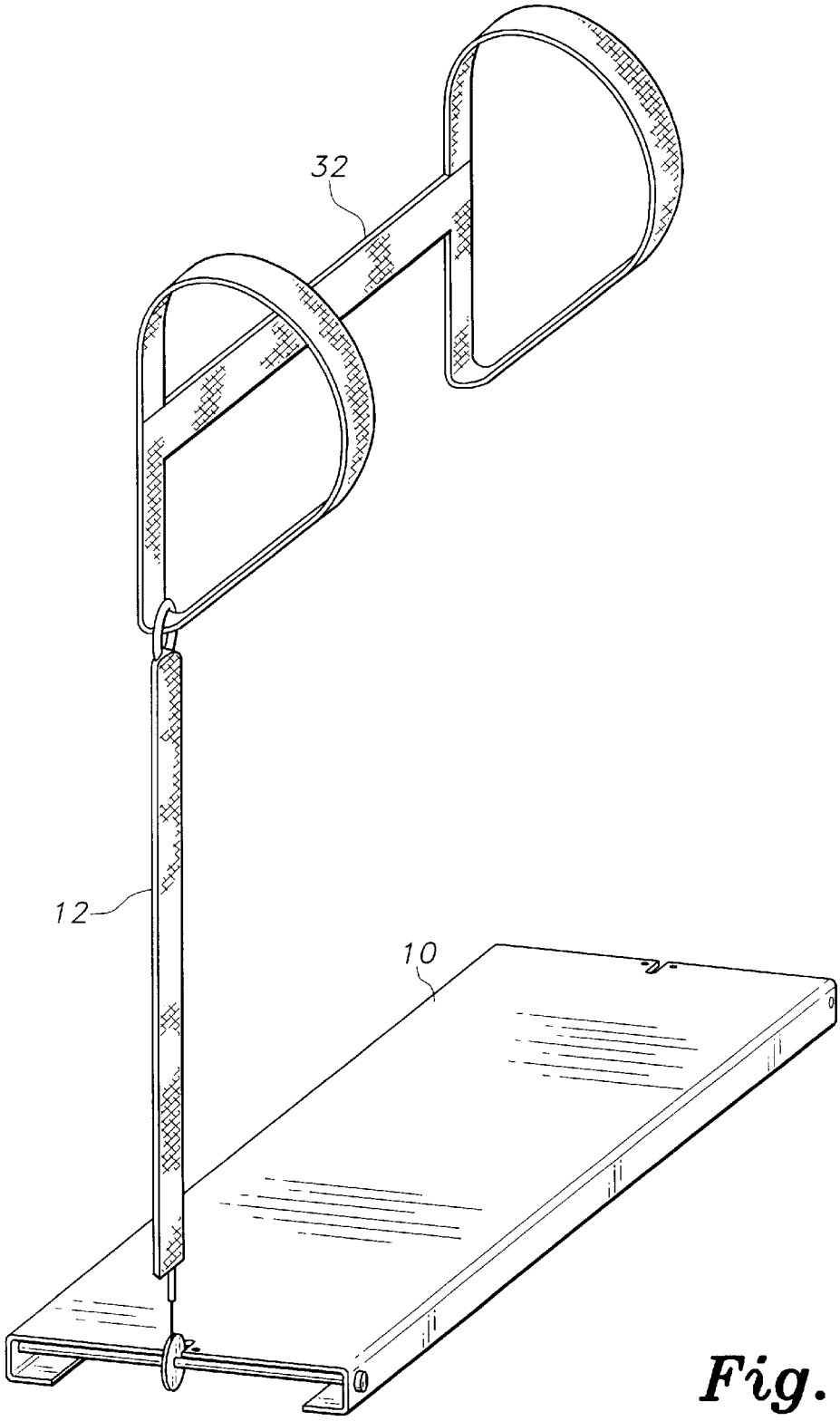
FIG. 6 is a perspective view of a harness lift used with a portable gym according to the present invention.
Figure 7:
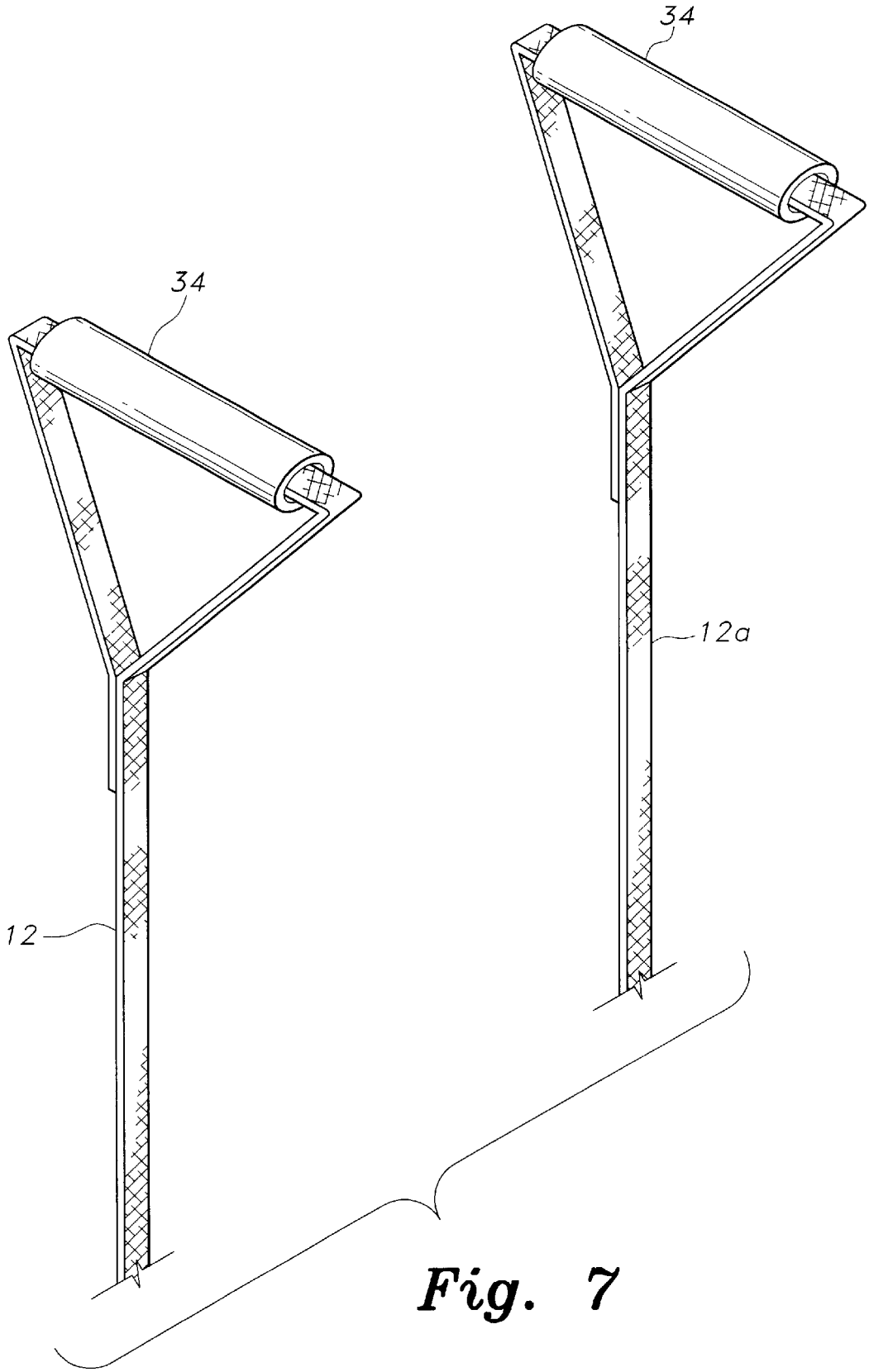
FIG. 7 is a perspective view of a handle lift used with a portable gym according to the present invention.

FIG. 5 is directed to a swivel hook connector 30 which allows the use of chains in lieu of straps. FIGS. 6 and 7 illustrate the respective employment of a harness 32 and handles 34 which may be used in squat or pull exercise regimens in lieu of an exercise bar.

Figure 8:
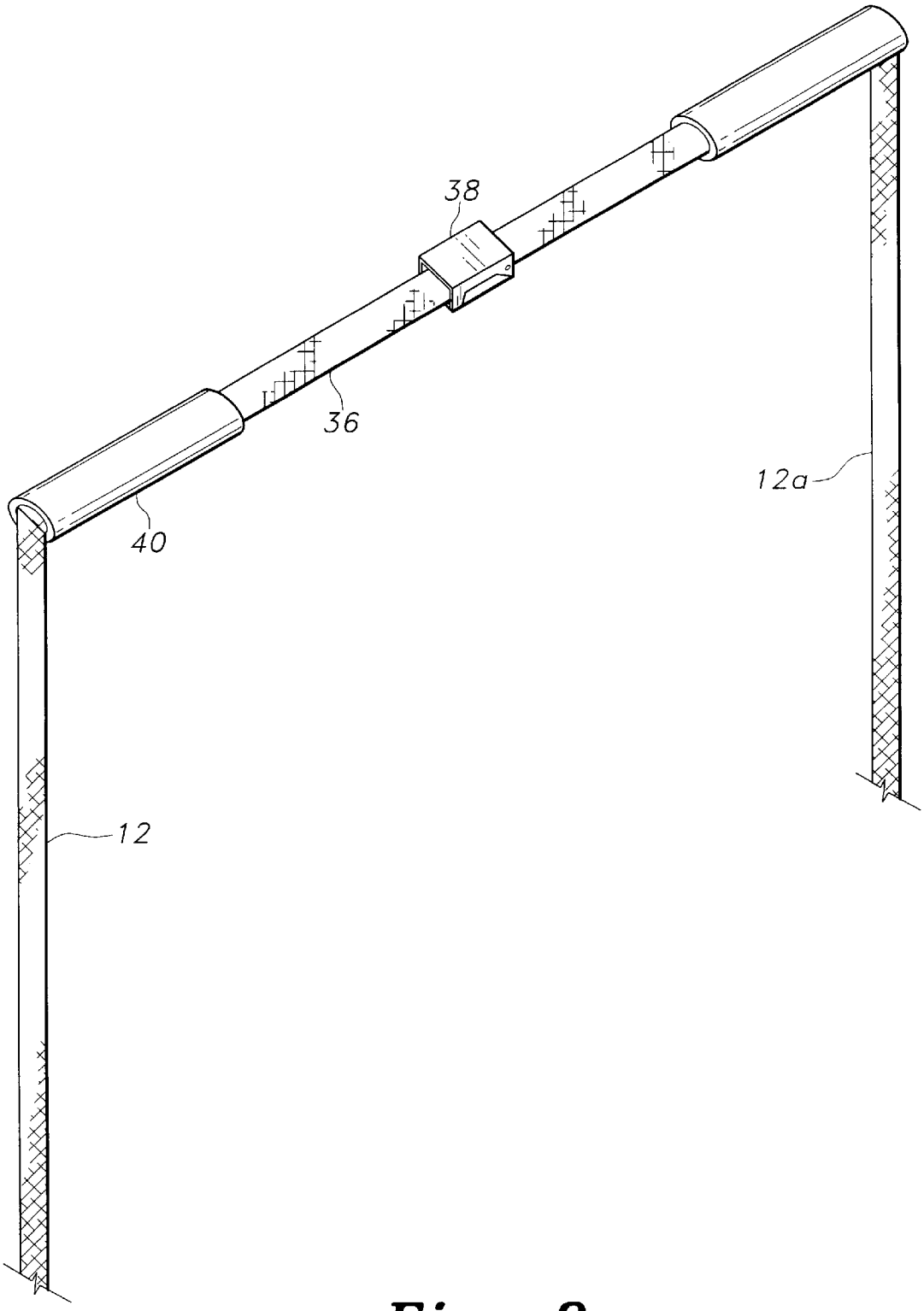
FIG. 8 is a perspective view of an adjustable lift bar used with a portable gym according to the present invention.

FIG. 8 illustrates the option of an adjustable bar 36 which may be utilized with or in lieu of adjustable straps. Bar 36 is fabricated from the same material as the straps and may be a continuation thereof. A clasp 38 permits a user to adjust the length of the bar. Stiffening tubes 40 are positioned to provide rigidity. Tubes 40 may be fabricated from any suitable rigid material (metal, plastic, hard rubber, etc.).

It is to be understood that the present invention is not limited to the sole embodiments described above, but encompasses any and all embodiments within the scope of the following claims.

I claim:

1. An isometric exercise apparatus comprising:

a platform having an upper planar surface, a lower planar surface, a first end and a second end, said platform adapted to be positioned on a supporting surface;

legs disposed on said lower planar surface, whereby said lower planar surface is spaced above said supporting surface;

a first slot formed through said platform adjacent said first end, said first slot extending through said upper planar surface and said lower planar surface;

a second slot formed through said platform adjacent said second end, said second slot extending through said upper planar surface and said lower planar surface;

a first pulley, said first pulley disposed in said first slot for rotation therein;

a second pulley, said second pulley disposed in said second slot for rotation therein;

a pair of wire cables, each cable of said pair having a first end and a second end, and wherein each cable of said pair extends beneath said lower planar surface and across a respective one of said first pulley and said second pulley and through a respective one of said first slot and said second slot; and means positioned adjacent said lower planar surface and attached to said pair of wire cables for measuring an effect of an isometric exercise.

2. The isometric exercise apparatus as recited in claim 1, including a pair of lifting straps, each strap of said pair having a lower end and an upper end, wherein the lower end of each strap is attached to a respective first end of each cable.

3. The isometric exercise apparatus as recited in claim 2, including a lifting member, said lifting member attached to said pair of lifting straps at each respective upper end.

4. The isometric exercise apparatus as recited in claim 3, wherein said lifting member is an exercise bar.

5. The isometric exercise apparatus as recited in claim 3, wherein said lifting member is a harness.

6. The isometric exercise apparatus as recited in claim 3, wherein said lifting ember comprises a pair of handles.

7. The isometric exercise apparatus as recited in claim 1, wherein said measuring means includes a load cell disposed adjacent said lower planar surface of said platform and a readout device connected to said load cell.

8. The isometric exercise apparatus as recited in claim 7, wherein said load cell is a S-type load cell.

9. The isometric exercise apparatus as recited in claim 7, wherein said load cell is a pressure-responsive load cell.

* * * * *